US006550722B1

(12) United States Patent
Kogler et al.

(10) Patent No.: US 6,550,722 B1
(45) Date of Patent: Apr. 22, 2003

(54) TONGUE BOX FOR GROOVED RAIL POINTS

(75) Inventors: Johann Kogler, Weisskirchen (AT); Bernhard Schusser, Weisskirchen (AT)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 09/980,546

(22) PCT Filed: Apr. 18, 2000

(86) PCT No.: PCT/AT00/00094

§ 371 (c)(1),
(2), (4) Date: Mar. 29, 2002

(87) PCT Pub. No.: WO00/65154

PCT Pub. Date: Nov. 2, 2000

(30) Foreign Application Priority Data

Apr. 27, 1999 (AT) ..... 744/99

(51) Int. Cl.[7] ..... B61L 5/00
(52) U.S. Cl. ..... 246/442; 246/435 R
(58) Field of Search ..... 246/415 R, 435 R, 246/436, 438, 441, 442, 443, 435 A, 463, 453, 380, 379, 462, 470; 238/311, 316, 338

(56) References Cited

U.S. PATENT DOCUMENTS 976,056 A * 11/1910 Ellis ..... 246/442
RE16,023 E * 3/1925 Dalton ..... 238/311
4,350,290 A 9/1982 Bush
4,634,087 A * 1/1987 Kempa ..... 246/430
5,127,613 A * 7/1992 Germann ..... 246/430
5,454,514 A * 10/1995 Pollock et al. ..... 238/311

FOREIGN PATENT DOCUMENTS

| | | | |
|---|---|---|---|
| CH | 237718 | 9/1945 | |
| DE | 482683 | 9/1929 | ..... 20/8 |
| DE | 485777 | 11/1929 | ..... 20/8 |
| DE | 835010 | 3/1952 | ..... 19/7 |
| DE | 3343239 C1 | 5/1985 | ..... E01B/7/08 |
| DE | 3904026 A1 | 8/1990 | ..... E01B/7/02 |
| LU | 41292 | 4/1962 | |

* cited by examiner

*Primary Examiner*—Mark T. Le
(74) *Attorney, Agent, or Firm*—Chapman and Cutler

(57) ABSTRACT

In order to enable the use of highly resistant materials difficult to weld or not weldable at all for a stock rail (2), the tongue box for grooved rail switches, which includes a stock rail (2), a slide plate (5) and a side rail (3), whereby the side rail (3) and the slide plate (5) and a base plate (4) are welded together forming a box-shaped section with the stock rail (2), is designed in a manner that the stock rail (2) is connected with the box-shaped profile in a positive and force-transmitting manner by clamping pieces that are welded with the box-shaped section and/or the base plate (4).

12 Claims, 3 Drawing Sheets

TONGUE BOX FOR GROOVED RAIL POINTS

The invention relates to a tongue box for grooved rail switches, which includes a stock rail, a slide plate and a side rail, whereby the side rail and the slide plate and a base plate are welded together forming a box-shaped section with the stock rail.

A tongue box of the initially defined kind may be taken, for instance, from DE 39 04 026 C2. In that known construction the stock rail, the slide plate, the side rail and the base plate are welded together so as to form a stable box-shaped structure. However, in order to realize such a weld it is, of course, necessary to use accordingly weldable steels so that highly wear-resistant steels will not be taken into consideration as stock rail materials unless cumbersome heat treatments are involved.

The problem of the poor weldability of accordingly wear-resistant steels has been recognized already in DE 33 43 239 C1. According to that earlier tongue device, a box section was screwed with the stock rail, this having been based on the fact that stock rails having the particular required rolled section, as a rule, will have an average carbon content of 0.6% by weight so as to enable welding only after sufficient preheating. Yet, the risk of incipient cracks in the region of the stock rail will continue to prevail on the respective ends of the base plates even after such preheating and even with a carefully realized weld, since the welding seam exerts a notch effect in that region. In order to eliminate the risk of further incipient cracks during the unavoidable leveling of the tongue zone after welding, a screwed structure was chosen in that case.

The invention aims to make use of the advantages of a welded structure in terms of stability while, nevertheless, enabling the use of highly wear-resistant stock rails without having to renounce the stability of a welded structure. To solve this object, the configuration according to the invention essentially consists in that the stock rail is connected with the box-shaped profile in a positive and force-transmitting manner by clamping pieces that are welded with the box-shaped section and/or the base plate. By using clamping pieces which are each capable of being welded with structural components made of readily weldable materials by what is called a shrink weld, a positive and force-transmitting connection is ensured, in which the risk of a loosening of screws or other detachable structural components will be avoided and all the advantages of a weldable structure in respect to the stability of the tongue box will be achieved.

Advantageously, the configuration according to the invention is devised such that the clamping piece is designed as a flange sleeve inserted through an opening of the rail web of the stock rail and connected with the box-shaped section by a shrink weld, and that the flange of the flange sleeve overlaps the opening of the web of the stock rail on the external side facing away from the box-shaped section. Such a flange sleeve which is inserted through an appropriate recess or opening of the rail web allows for not only the respective positive and force-transmitting connection after shrink welding by pressing the flange of the flange sleeve, but also a positive connection by insertion in the opening of the rail web, thereby avoiding direct welding between the poorly weldable material of the highly wear-resistant stock rails and the structural components of the box section. The weld joint may, therefore, be realized in a conventional manner without cumbersome heat treatment while safeguarding the required stability. In a particularly simple manner, the configuration may be rendered even more rigid in that the rail foot of the stock rail is overlapped by plate-shaped clamping pieces welded with the base plate. On account of the shrinking process involved in the welding of the plates, such plate-shaped clamping pieces may likewise effect an additional positive and force-transmitting connection so as to further enhance the stability of the construction.

Advantageously, highly wear-resistant materials may be used as materials for the stock rails, the configuration advantageously being devised such that the stock rail is designed as a grooved rail of steel with a hardened head and a carbon content of 0.6–0.9% by weight, in particular 0.8% by weight, and strength values of the base body ranging between 850 and 1050 N/mm$^2$ and strength values of the head ranging between 1100 and 1200 N/mm$^2$ and that, in particular, a naturally hard steel, type R 800 or type R 900 A, or quenched and subsequently drawn steels, type HSHM or HSH, are used for the stock rails. Such steels having carbon contents of about 0.8% by weight are weldable only to a limited extent or not at all and can be rendered weldable merely by special welding processes or by preheating prior to welding, for instance in a gas furnace to approximately 500° C., or are ruled out for such applications. Such preheating may be obviated and their application safeguarded by using clamping pieces. Since no longitudinal seams as would occur in the welding of the rail to the base plate are formed by the shrink welding according to the invention, a finishing procedure by leveling is required not at all or to a slight extent only.

Advantageously, the good weldability of the box section and the clamping pieces to be welded with the box section is safeguarded in that the side rail and the structural components of the welded box-shaped section are made of readily weldable structural steel, in particular grade ST50 steel.

The box-shaped section may be formed completely using supporting plates already prior to the fixation of the stock rails by shrink welding of the flange sleeve, to which end the configuration advantageously is devised such that the welded box-shaped section is comprised of supporting plates which are parallel in cross section and of the slide plate welded with the supporting plates as well as the base plate extending parallel with the slide plate, the side rail being welded with one of the two supporting plates. The fixation of the stock rails in the instant case is effected in a simple manner in that the flange sleeve is connected with the supporting plate located opposite the side rail, whereby, in order to ensure an appropriate shrink effect and hence an accordingly positive and force-transmitting connection, the configuration advantageously is devised such that the axial length of the flange sleeve inserted with the flange abutting on the web of the stock rail is smaller than the width of the web of the stock rail and that the annular gap between the flange sleeve and the supporting plate is closed by a shrink weld. After solidification of the weld seam introduced into the annular gap by slot welding, a suitable clamping action will occur by thermal contraction, thus safeguarding the high stability and strength.

The stability may be additionally enhanced in that supporting elements are welded with the base plate to laterally support the stock rail.

In the following, the invention will be explained in more detail by way of an exemplary embodiment schematically illustrated in the drawing. Therein:

Figure 1:
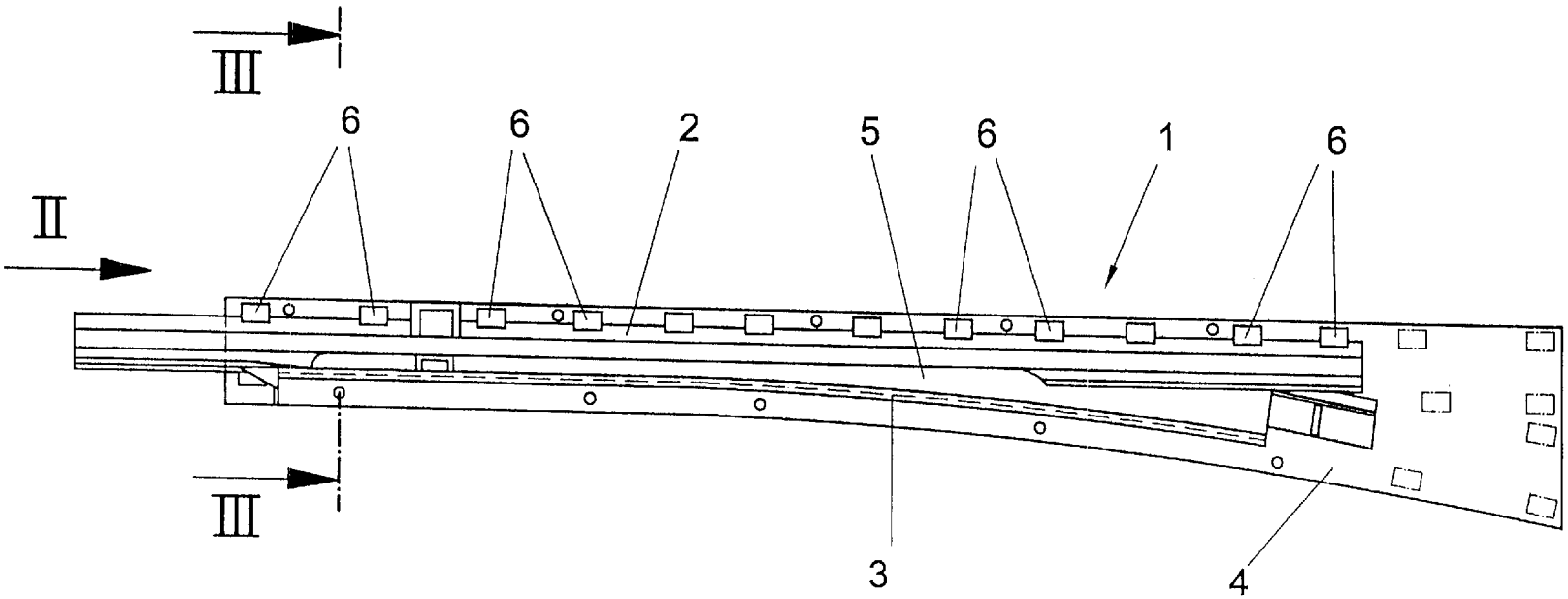
FIG. 1 is a top view on the tongue box of a grooved rail switch.

FIG. 1 depicts a tongue box 1 with the stock rail 2, the side rail 3, the base plate 4 and the slide plate 5 being visible in top view. The stock rail 2 is fixed to the base plate 4 by means of plate-shaped clamping pieces 6 welded with the base plate.

Figure 2:
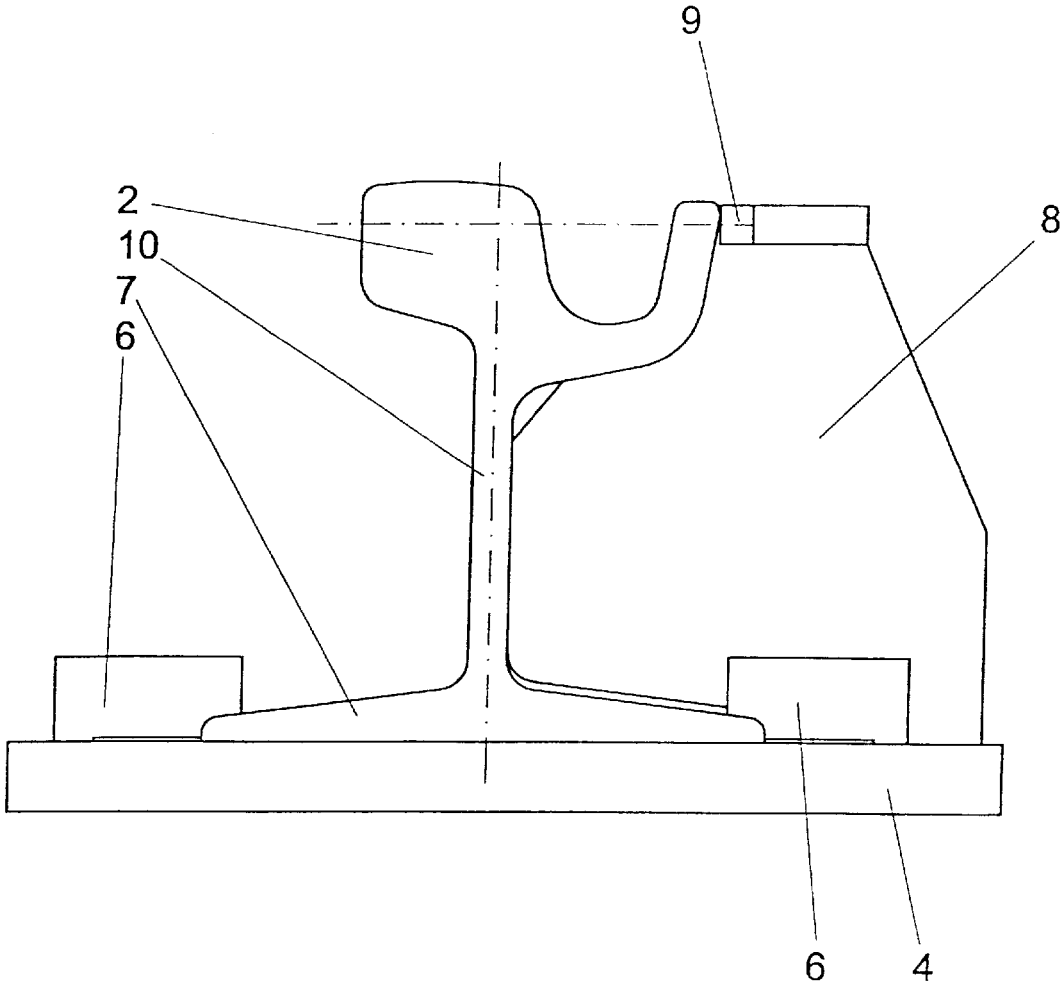
FIG. 2 is a view in the sense of arrow II of FIG. 1.

From FIG. 2, the grooved rail section of the stock rail 2 made of a highly wear-resistant grooved rail material is apparent, the plate-shaped clamping elements 6 overlapping the rail foot 7 of the stock rail 2. Furthermore, lateral supports 8 are welded with the base plate 4, which, together with the supporting members 9, provide lateral support for the grooved rail 2. The rail web of the stock rail 2 is denoted by 10.

Figure 3:
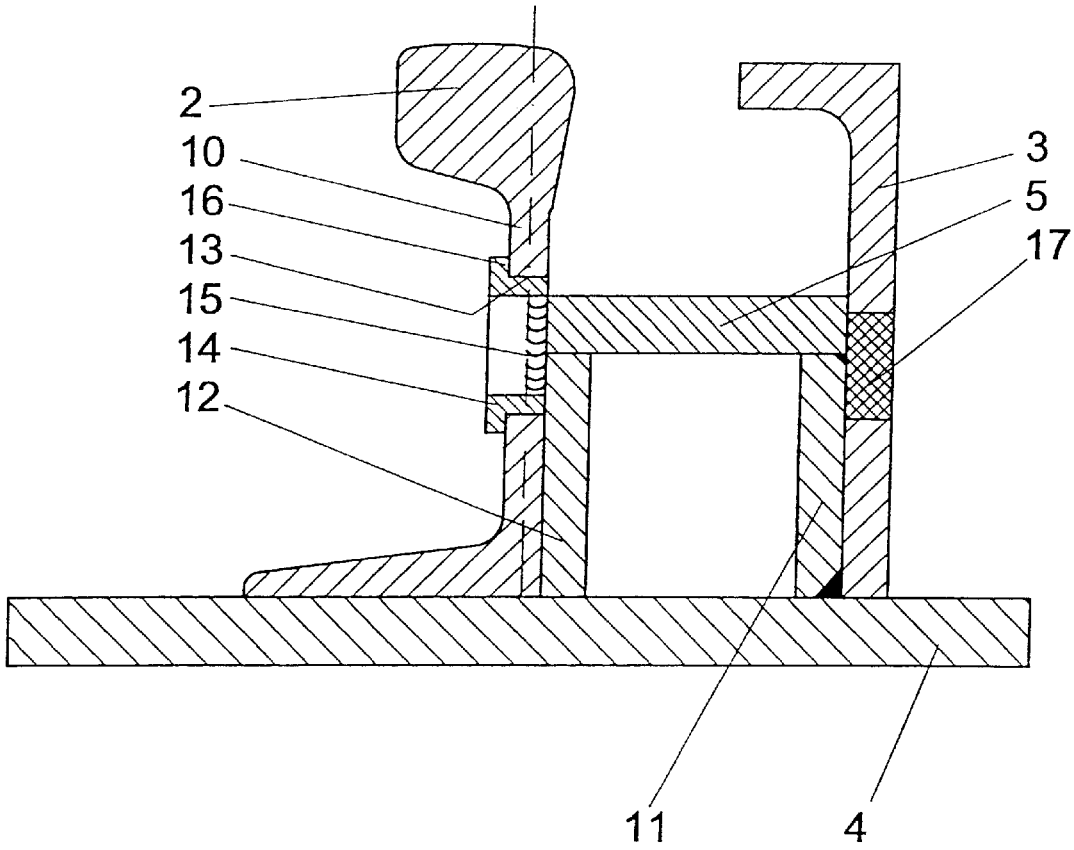
FIG. 3 is a section along line III—III of FIG. 1.

From the illustration according to FIG. 3, the box-shaped construction is visible in more detail. The box-shaped section is comprised of the base plate 4, the slide plate 5, in which the tongue of the rail switch is slidingly guided, as well as two vertically extending supporting plates 11 and 12. The rail web 10 of the stock rail 2 has an opening 13 in which a flange sleeve 14 is inserted. The flange sleeve 14 is welded with one of the plate-shaped supporting parts 12 by slot welding with the weld seam being denoted by 15, whereby shrink welding is effected in the instant case, which causes the flange 16 of the flange sleeve 14 externally encompassing the opening 13 of the rail web to be pressed against the rail web in a positive and force-transmitting manner, thus connecting the rail web with the box section in a positive and force-transmitting manner.

The side rail is again denoted by 3 and may be welded with the base body of the box-shaped section by conventional slot welding 17.

What is claimed is:

1. A tongue box for grooved rail switches, which includes a stock rail (2), a slide plate (5) and a side rail (3), whereby the side rail (3) and the slide plate (5) and a base plate (4) are welded together forming a box-shaped section with the stock rail (2), wherein the stock rail (2) is connected with the box-shaped section in a positive and force-transmitting manner by clamping pieces that are welded with the box-shaped section and/or the base plate (4), wherein the clamping pieces include at least a flange sleeve (14) inserted through an opening (13) of a rail web (10) of the stock rail (2) and connected with the box-shaped section by a shrink weld, and a flange (16) of the flange sleeve (14) overlaps the opening (13) of the rail web (10) of the stock rail (2) on the external side facing away from the box-shaped section.

2. A tongue box according to claim 1, wherein a rail foot (7) of the stock rail (2) is overlapped by the clamping pieces (6) welded with the base plate (4).

3. A tongue box according to claim 1, wherein the stock rail (2) is a grooved rail of steel with a hardened head and a carbon content of 0.6–0.9% by weight, in particular 0.8% by weight, and strength values of the base body ranging between 850 and 1050 $N/mm^2$ and strength values of the head ranging between 1100 and 1200 $N/mm^2$.

4. A tongue box according to claim 2, wherein the stock rail (2) is a grooved rail of steel with a hardened head and a carbon content of 0.6–0.9% by weight, in particular 0.8% by weight, and strength values of the base body ranging between 850 and 1050 $N/mm^2$ and strength values of the head ranging between 1100 and 1200 $N/mm^2$.

5. A tongue box according to claim 3, wherein steel, type R 800 or type R 900 A, or type HSH or HSHM, is used for the stock rails (2).

6. A tongue box according to any one of claims 1, 2, 3, 4, or 5, wherein the side rail (3) and structural components of the welded box-shaped section are made of readily weldable structural steel, in particular steel having a strength value of 500 $N/mm^2$.

7. A tongue box according to any one of claims 1, 2, 3, 4, or 5, wherein the welded box-shaped section is comprised of supporting plates (11, 12) which are parallel in cross section and of the slide plate (5) welded with the supporting plates as well as the base plate (4) extending parallel with the slide plate, the side rail being welded with one of the two supporting plates (11, 12).

8. A tongue box according to any one of claims 1, 2, 3, 4, or 5, wherein the flange sleeve (14) is connected with the supporting plate (12) located opposite the side rail (3).

9. A tongue box according to any one of claims 1, 2, 3, 4, or 5, wherein an axial length of the flange sleeve (14) inserted with the flange (16) abutting on the web (10) of the stock rail (2) is smaller than a width of the web (10) of the stock rail (2) and that an annular gap between the flange sleeve (14) and the supporting plate (12) is closed by a shrink weld.

10. A tongue box according to any one of claims 1, 2, 3, 4, or 5, wherein supporting members (9) are welded with the base plate (4) to laterally support the stock rail (2).

11. A tongue box for grooved rail switches, which includes a stock rail (2), a slide plate (5) and a side rail (3), whereby the side rail, (3) the slide plate (5) and a base plate (4) are welded together forming a box-shaped section with the stock rail (2), the stock rail (2) being connected with the box-shaped section in a positive and force-transmitting manner by clamping pieces that are welded with the box-shaped section and/or the base plate (4), wherein the clamping pieces include at least a flange sleeve (14) inserted through an opening (13) of a rail web (10) of the stock rail (2) and connected with the box-shaped section by a shrink weld, and a flange (16) of the flange sleeve (14) overlaps the opening (13) of the rail web (10) of the stock rail (2) on the external side facing away from the box-shaped section, with the side rail (3) and structural components of the welded box-shaped section being made of readily weldable structural steel, in particular steel having a strength value of 500 $N/mm^2$, wherein the welded box-shaped section is comprised of supporting plates (11, 12) which are parallel in cross section and of the slide plate (5) welded with the supporting plates as well as the base plate (4) extending parallel with the slide plate, the side rail being welded with one of the two supporting plates (11, 12).

12. A tongue box for grooved rail switches, which includes a stock rail (2), a slide plate (5) and a side rail (3), whereby the side rail (3) the slide plate (5) and a base plate (4) are welded together forming a box-shaped section with the stock rail (2), the stock rail (2) being connected with the box-shaped section in a positive and force-transmitting manner by clamping pieces that are welded with the box-shaped section and/or the base plate (4), wherein the clamping pieces include at least a flange sleeve (14) inserted through an opening (13) of a rail web (10) of the stock rail (2) and connected with the box-shaped section by a shrink weld, and a flange (16) of the flange sleeve (14) overlaps the opening (13) of the rail web (10) of the stock rail (2) on the external side facing away from the box-shaped section, with the side rail (3) and the structural components of the welded box-shaped section being made of readily weldable structural steel, in particular steel having a strength value of 500 $N/mm^2$, wherein the supporting members (9) are welded with the base plate (4) to laterally support the stock rail (2).

* * * * *